United States Patent [19]

Proa

[11] Patent Number: 5,058,757

[45] Date of Patent: Oct. 22, 1991

[54] BEVERAGE INSULATOR WITH RETRACTABLE SHADER

[76] Inventor: Pedro O. Proa, 10951 Stone Canyon Rd., #382, Dallas, Tex. 75230

[21] Appl. No.: 573,690

[22] Filed: Aug. 28, 1990

[51] Int. Cl.[5] ..... A47G 19/00

[52] U.S. Cl. ..... 220/85 H; 220/903

[58] Field of Search ..... 220/85 H, 85 R, 903, 220/603, 904

[56] References Cited

U.S. PATENT DOCUMENTS

| | | | |
|---|---|---|---|
| 3,905,511 | 9/1975 | Groendal | 220/903 X |
| 4,293,015 | 10/1981 | McGough | 150/52 R |
| 4,303,170 | 12/1981 | Panicci | 220/603 |
| 4,312,465 | 1/1982 | Sinkhorn et al. | 220/85 H X |
| 4,372,453 | 1/1983 | Branscom | 215/13 R |
| 4,494,672 | 1/1985 | Pearson | 220/85 H X |
| 4,510,665 | 4/1985 | Scheurer | 29/460 |
| 4,540,611 | 9/1985 | Henderson | 428/12 |
| 4,720,023 | 1/1988 | Jeff | 220/412 |
| 4,872,577 | 10/1989 | Smith | 220/264 X |
| 4,892,215 | 1/1990 | Carlson et al. | 220/903 X |
| 4,927,047 | 5/1990 | Stuber et al. | 220/903 X |

OTHER PUBLICATIONS

A2Z advertisement—Beach Umbrella Sugar and Creamer, Stock No. 768747.

A2Z advertisement—Beach Chair Drink Set, Stock No. 768754.

*Primary Examiner*—Steven M. Pollard

*Attorney, Agent, or Firm*—Richards, Medlock & Andrews

[57] ABSTRACT

A beverage insulator (10) is provided with a cylindrical portion (20) of insulating material and a shader (30) extending therefrom to shade the top of a beverage can (12) from the sun. The cylindrical portion (20) is designed to be easily gripped and to allow easy insertion of a standard aluminum can. It is further provided with a flared and ballasted base (24) to add stability. The shader may be fixed or retractable. In the latter embodiment, the shader retracts when a lever (44) attached to cylindrical portion (20) is compressed. Upon the lever's release, the shader (30) resumes its protective position. In an alternate embodiment, a shader is provided to be used with a standard beverage copy. In this embodiment, the shader (30) is fixed on a shaft (40), said shaft (40) being insertable between the inner surface of the cozy (20) and beverage can (12) therein.

31 Claims, 3 Drawing Sheets

BEVERAGE INSULATOR WITH RETRACTABLE SHADER

TECHNICAL FIELD OF THE INVENTION

The present invention relates to an insulating device for beverage cans. More specifically, a beverage insulator is provided with a retractable shader to shade the top of the beverage can from radiative warming from the sun.

BACKGROUND OF THE INVENTION

Cold beverages are especially popular during the warmer months of spring, summer, and early fall. Yet, when one participates in outdoor activities, his drink will warm under the blare of the hot sun. The drink within the beverage can warms because heat and electromagnetic radiation from the surrounding environment will transfer across the surface of the can and into the drink. Indeed, heat transfer is driven solely by the difference between the temperature of the environment and the temperature of the soft drink.

Heat transfer occurs through three mechanisms: conduction, convection, and radiation. Conduction refers to heat transfer that occurs across a medium such as a warm hand touching an aluminum can. Convection refers to heat transfer that will occur between a surface and a moving fluid when they are at different temperature. In this instance, the moving fluid could be a warm summer breeze. Thermal radiation occurs because all surfaces of finite temperature emit energy in the form of electromagnetic waves. The sun emits electromagnetic waves which travel through space and retransform into heat when they strike an absorbing object. The waves can also be substantially reflected away by a reflective object. Hence, even in the absence of an intervening medium, there can be net heat transfer by radiation between two surfaces at different temperatures.

A beverage cozy, also known as a "coozy," is a cylindrical device designed to snugly fit around a standard aluminum beverage can. In general, these devices are made of an insulating material. The device inhibits heat transfer by preventing convective heat transfer from a large percentage of the can's surface area. The cozy also inhibits conductive heat transfer by presenting a material with a low heat transfer coefficient adjacent to the highly conductive aluminum can.

Various patents have issued involving beverage insulators. For example, U.S. Pat. No. 4,872,577 to Smith discloses a hinged closure attachment for insulated beverage can container. The closure attachment comprises an annular band, a lid of insulating material to match that of the container, and hinge means mounting the lid on the band. The lid is in the form of a low-profile inverted cup and is diametrically dimensioned to overlie the top of the marginal edge of the container. The band tightly encircles the marginal edge of the container. The hinge contains a spring biasing the lid to the closed position.

U.S. Pat. No. 4,720,023 to Jeff discloses a combination insulated mug and beverage can holder. The holder is comprised of a one-piece flexible ring-shaped retainer with an annular groove that mounts on the upper rim of an insulated mug. When the retainer is fitted to the mug's upper rim, the insulated mug functions as an insulated holder for a beverage can. When the retainer is not attached, the mug functions as a normal drinking vessel.

U.S. Pat. No. 4,540,611 to Henderson discloses a one-piece insulator for beverages. The device is cut from a sheet of insulative foam and laminated with a surface vinyl film. The holder pattern is folded over on itself and the side edges are stitched or vinyl welded together.

U.S. Pat. No. 4,372,453 to Branscom discloses an insulated container holder as well. The cylindrical holder is made of either a rigid foam or may be of double wall construction to provide thermal insulation. A pivotal cap is received by the cylindrical holder, said cap having a central opening overlying that of the cylinder. After a beverage can is inserted, this cap is pivoted, thereby gripping the can.

U.S. Pat. No. 4,293,015 to McGough discloses an insulated beverage cozy comprised of a cylindrical body with an inner wall and an outer wall. These walls are fastened together to form a plurality of compartments for holding goose down or other insulative materials. An elastic top band is attached to the top of the cozy to hold it snugly to the beverage container.

Each of these designs is useful at blocking against conductive and convective heat loss from the sides and bottom of the can. However, the devices illustrated in the patents to Jeff, Henderson, Branscom and McGough fail to inhibit heat transfer across the top of the beverage can. While the device illustrated in the patent to Smith covers the top of a can with insulation, the device is cumbersome and must be held back when the beverage is consumed. Therefore, a need exists for a beverage insulator which inhibits the warming of cold drinks in beverage cans placed into the insulator by reducing conductive, convective, and radiative heat transfer across the surface of the can. The device must allow easy insertion of the can therein. This device should have easily adjustable means to shade the top of the can from the sun's rays, thus inhibiting the warming of the can's top and the drink contained therein. Also, this means to shade should be easily retractable to allow access to the top of the can.

SUMMARY OF THE INVENTION

This invention relates to a novel beverage insulator with a shader or umbrella. The present device displays improved heat transfer inhibiting qualities when compared to prior art beverage insulators. In one embodiment, the insulator is comprised merely of a fixed shader. The shader is attached to a shaft. This shaft is dimensioned to fit between the inner surface of a standard beverage cozy and the beverage can therein. The tilt of the shader can be adjusted by manually rotating it about a pivot-point attachment to the shaft. In another embodiment, the beverage insulator can be comprised of a cylindrical piece of insulating foam, or cozy, with a fixed position shader thereover. The cozy can be dimensioned to fit snugly around a standard aluminum can. The shader can be held over one end of the cylinder by means of a shaft attached to the cozy. The shader shades the exposed can top from the sun, thus reducing radiative heat transfer.

In another embodiment, the shader can be designed to retract from a position over the cylindrical cozy. When the cozy is grasped, a means to retract the shader is engaged and the shader drops away from its position over the end of the cozy. When the cozy is released, the shader resumes it original position over the cylindrical cozy. The shader can be attached to the cylinder by a hinged two-piece shaft. The lower shaft portion can be substantially fixed to the cozy while the upper shaft portion extends thereover. The means to retract the shader can be comprised of a fixed length cord attached from the base of the upper shaft to the top of a lever rotatably attached to the base of the lower shaft. Further, a spring can be placed between the lower shaft and the lever. Therefore, when the insulator is grasped, the lever is engaged and the spring is compressed, allowing the cord to slack and the upper shaft portion and the shader to fall away from above the cozy. This removes the shader as an obstacle to drinking the beverage. When the insulator is released, the spring expands, making the cord taut, thereby conveying the spring's force and raising the shader. Further, when the shader is over the cylinder, its position can be adjusted to compensate for the location of the sun.

In a preferred embodiment, the insulator is comprised of a retractable shader and a cylinder with a flared and ballasted base. This adds to the stability of the design. The ballast would lower the center of gravity for the insulator, thereby compensating for the shader's presence above the insulator. The lower center of gravity helps prevent accidental tipping of the insulator and beverage. In this embodiment, the shader may also be retractable. Additional features might include a clock embedded in the cozy and pouches for holding keys or sunglasses. The shader may also be used for advertising.

BRIEF DESCRIPTION OF THE DRAWINGS

For a more complete understanding of the invention, and for further details and advantages thereof, reference is now made to the following Detailed Description taken in conjunction with the accompanying drawings, in which.

DETAILED DESCRIPTION

Figure 1:
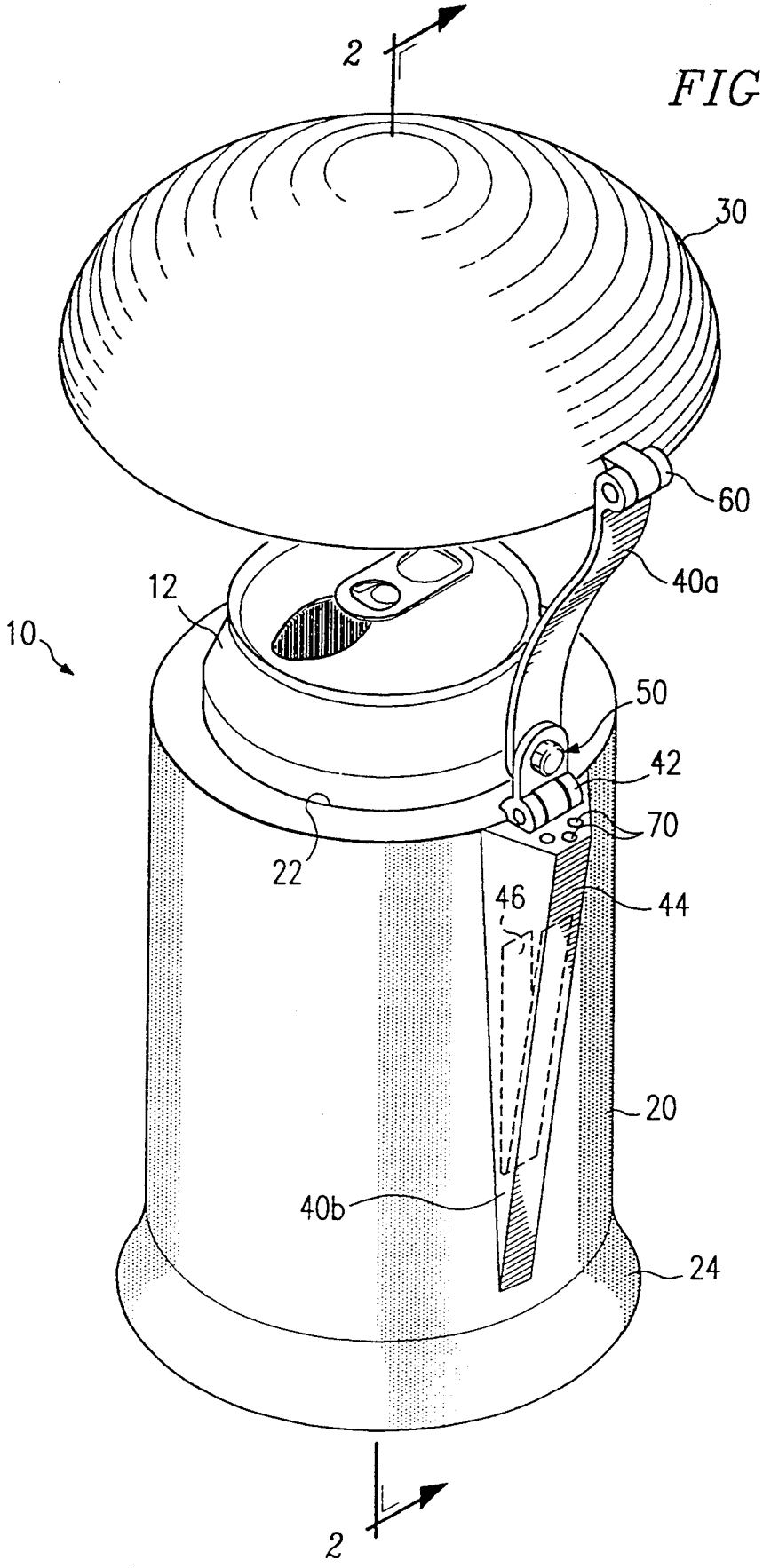
FIG. 1 is a perspective view of the beverage insulator with a retractable shader.

The present invention is a beverage insulator with retractable shader that overcomes many of the disadvantages found in the prior art. Referring to FIG. 1, a beverage insulator 10 embodying the present invention is disclosed. Insulator 10 is comprised of cylindrical cozy 20 and a shader 30 suspended over the cozy by shaft 40.

The cylindrical cozy 20 is comprised of a cylindrical structure with an open end 22 and a closed end 24. The cozy 20 near closed end 24 can be flared to have a greater outer diameter than open end 22. The cozy 20 is dimensioned to snugly fit around a standard aluminum beverage can 12. Therefore, the inner diameter is preferably 2½ inches or less while the height is 4⅞ inches or less. The cozy is typically made of a flexible insulating material which allows for placement of slightly larger diameter cans or bottles therein. The insulating material may be a foam or even a foam with large air pockets therein. The base 24 may be weighted by ballasting material 26 (not shown). Ballast 26 would serve to lower the center of gravity of the beverage insulator thereby inhibiting accidental tippage.

Shader 30 is suspended over the cozy 20 by a shaft 40 and must be of suitable dimensions to shade can 12 from the sun. Shader 30 is typically a curved, circular surface with a concave and a convex surface, preferably with said concave surface adjacent said cozy and a highly reflective coating on the convex surface. Shaft 40 typically has a curved upper portion 40*a* and a straight lower portion 40*b*. Lower portion 40*b* is attached to cozy 20. Upper portion 40*a* is rotatably attached to the base of lower portion 40*b* by hinge 42. A lever 44 is rotatably attached to lower shaft portion 40*b* by pin 48 (not shown). A spring 46 is positioned between lower shaft portion 40*b* and lever 44. Upper shaft portion 40*a* is rotatably attached to hinge 42 at joint 50. The upper portion 40*a* is also pivotably attached to shader 30 at hinge 60. Hinge 60 is preferably weighted, thereby shifting the center of gravity for the combination of the upper shaft portion 40*a* and shader 30 to a point behind the plane including lower shaft portion 40*b*.

Figure 2:
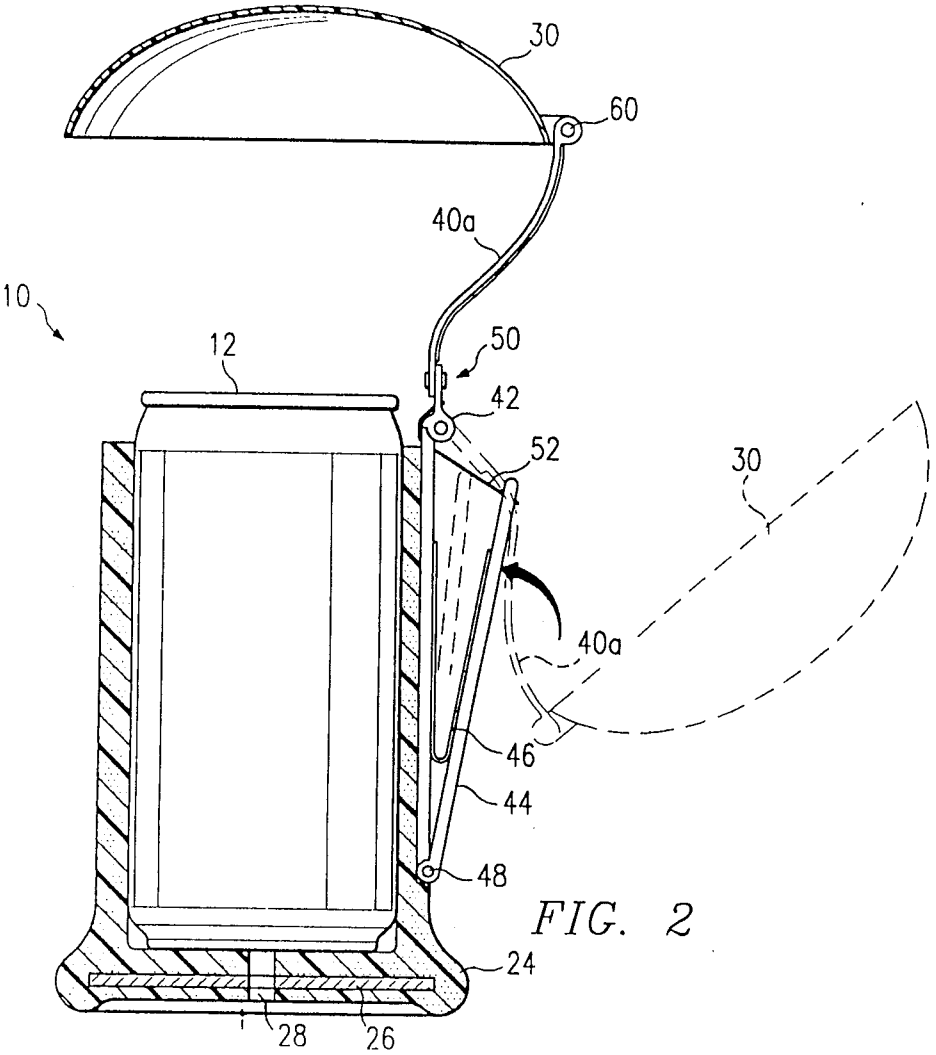
FIG. 2 is a cross-sectional view across line 2—2 of the beverage insulator with a retractable shader.

FIG. 2 provides a cross-sectional view of insulator 10 along line 2—2 as shown in FIG. 1. Cozy 20 is shown with a flared base 24 and a ballast 26. A hole 28 can also penetrate base 24 to diminish any vacuum effect experienced while removing the beverage can from the insulator. Lever 44 is attached to lower portion 40*b* of shaft 40 at pin 48. Spring 46 opposes the movement of lever 44, while string 52 limits the travel of lever 44. When compressed in the direction shown, the lever 44 allows string 52 to become slack. Vent holes 70 may be positioned to allow air in and out of the area where spring 46 is located. When slack, the string 52 allows hinge 42, upper shaft portion 40*a*, and shader 30 to fall away from can 12. The retracted position of shader 30 and upper shaft portion 40*a* is shown in shadow. When lever 44 is released, spring 46 expands, thereby drawing string 52 taut. When taut, the string 52 rotates hinge 42, upper shaft portion 40*a*, and shader 30 into a position above can 12.

Figure 3:
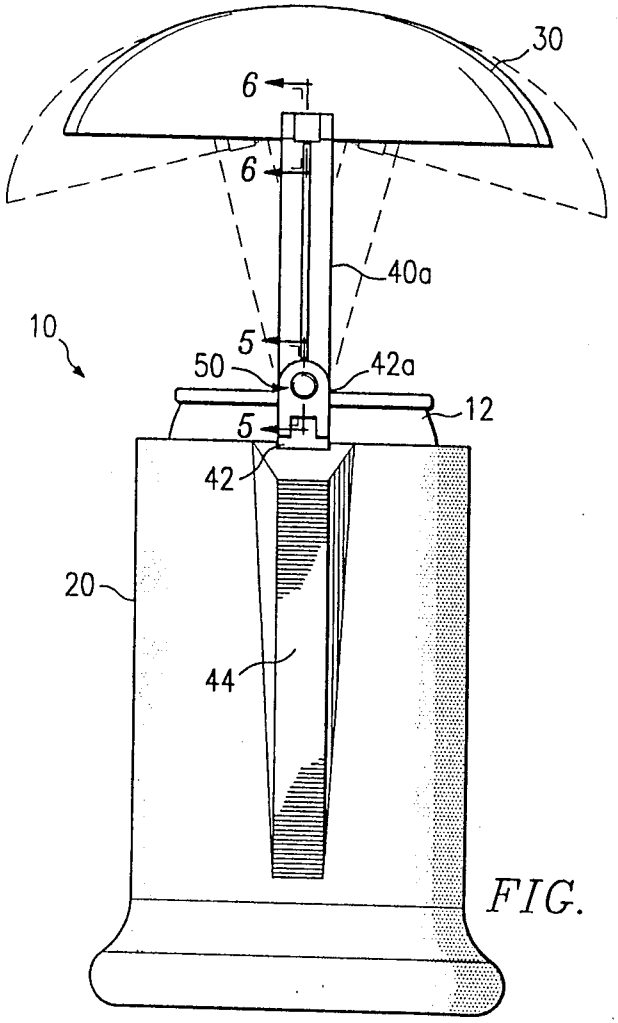
FIG. 3 illustrates the lateral adjustability of the shader.

FIG. 3 illustrates the adjustable nature of shader 30. Shader 30 and upper shaft portion 40*a* rotatably adjust around joint 50 on hinge 42. When insulator 10 is used outdoors, it is important to adjust shader 30 as the sun changes position. The lateral movement allowed by joint 50 makes this possible.

Figure 4A:
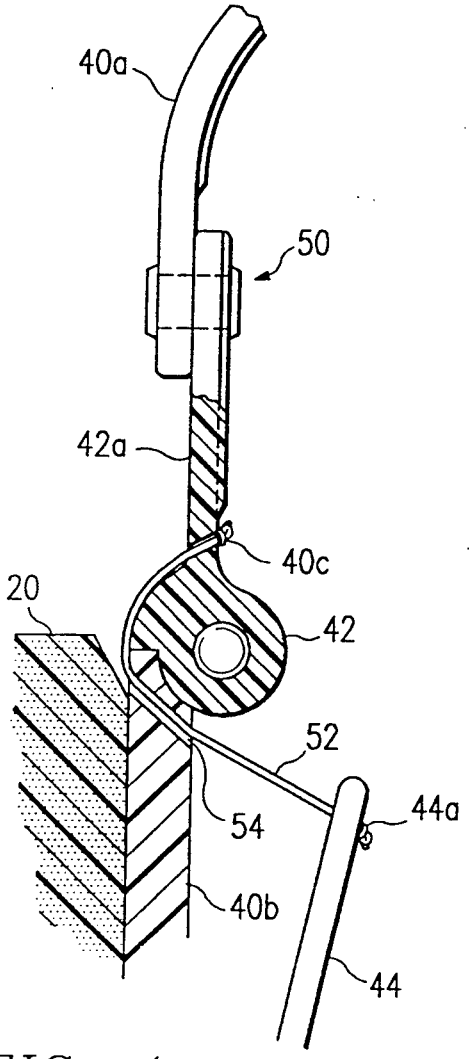
FIG. 4*a* is a detailed cross-section of the shaft when the shader is engaged.
Figure 4B:
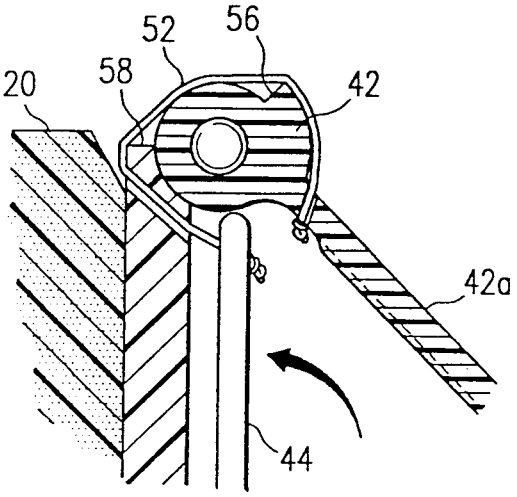
FIG. 4*b* is a detailed cross-section of the shaft when the shader is disengaged.

FIGS. 4*a* and 4*b* illustrate the connection between lever 44 and upper shaft portion 40*a* in greater detail. String 52 is attached to lever 44 at attachment point 44*a*. The string 52 passes through slot 54 in lower shaft portion 40*b* and attaches to upper shaft portion 40*a* at attachment point 40*c*. Hinge 42 rotatably engages lower shaft portion 40*b*. Rotation of hinge 42 is limited when stop notch 56 on hinge 42 engages upper surface 58 of lower shaft portion 40*b*. FIG. 4*a* illustrates the relationship between hinge 42 and lower shaft 40*b* when shader 30 is upright. FIG. 4*b* illustrates the position of hinge 42 when shader 30 has fallen away from cozy 20. Lever 44 is pressed toward lower shaft portion 40*b*, compressing spring 46 and allowing string 52 to go slack. When string 52 goes slack, upper shaft portion 40*a* and shader 30 fall away from their upright position. Shader 30 falls because its center of gravity is behind the plane formed by lower shaft portion 40*b* due to upper shaft portion 40*a* and hinge 60 being weighted. Thus, gravity produces a torque 20 on upper shaft portion 40*a* which is opposed by spring 46 via string 52. Upper surface 58 of lower shaft portion 40*b* may be angled to provide additional impetus for the shader to fall away from cozy 20. The distance shader 30 falls can be limited by the length of string 52.

Figure 5:
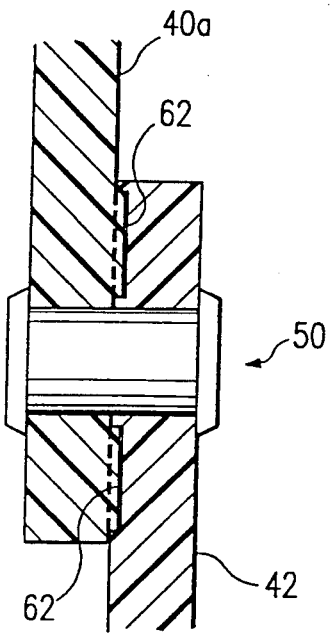
FIG. 5 is a cross-sectional view across line 5—5 of the radially aligned mating teeth, which allow lateral adjustment of the shader.

FIG. 5 is a cross-sectional view of joint 50 along line 5—5 shown in FIG. 3. Upper shaft portion 40*a* is connected to hinge 42 by rotational joint 50. Joint 50 therefore allows upper shaft portion 40*a* to rotate relative to hinge 42. This rotation produces the lateral movement of shader 30 shown in FIG. 3. The rotation can be made in step-wise fashion by the inclusion of radially aligned mating teeth 62 on both upper shaft portion 40*a* and hinge 42.

Figure 6:
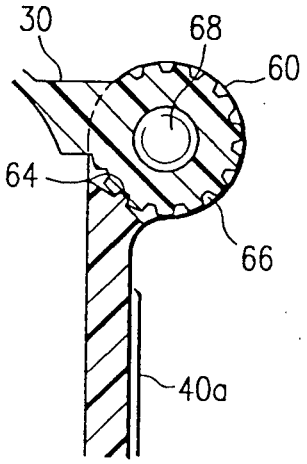
FIG. 6 is a cross-sectional view across line 6—6 of the hinge which allows tilt adjustment of the shader shade.

FIG. 6 is a cross-sectional view of hinge 60 across line 6—6 as shown in FIG. 3. Hinge 60 connects upper shaft portion 40*a* and shader 30. Shader 30 may be adjustably rotated around central pin 68. Step-wise adjustment is possible when protrusion 64 at the distal end of upper shaft portion 40*a* acts as a detent for notches 66.

Although preferred embodiments of the invention have been described in the foregoing Detailed Description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. An apparatus for insulating a beverage can inserted in an cylindrical insulating cozy comprising:

(a) a shader, wherein said shader is dimensioned to shade the entire can surface; and (b) means to suspend said shader above the beverage can comprising a shaft with a distal end and a proximal end, said proximal end slidably insertable between said beverage can and said insulating cozy, said distal and rotatably attached to said shader.

2. An apparatus for insulating a beverage can comprising:

(a) an insulator for receiving a beverage can; and (b) means to shade said beverage can attached to said insulator wherein said means to shade said beverage can is comprised of:

(i) a shader, wherein said shader is dimensioned to shade the entire can surface; and (ii) a shaft connecting said shader to said insulator in spaced relationship above said beverage can.

3. The apparatus of claim 2, wherein said cozy is comprised of a hollow cylindrical piece of insulating material with at least one open end.

4. The apparatus of claim 2, wherein said cozy is further comprised of a structure with a closed base, said base being flared and ballasted.

5. The apparatus of claim 2, wherein said convex surface of said shader is reflective.

6. The apparatus of claim 2, wherein said shaft is rigidly attached to said cozy.

7. The apparatus of claim 2, wherein said shaft is rotatably attached to said shader.

8. The apparatus of claim 2, wherein said shaft is rotatably attached to said shader.

9. An apparatus for insulating a beverage can comprising:

(a) a cozy, said cozy comprising a hollow, cylindrical piece of insulating material having at least one open end for receiving said beverage can;

(b) a shader for shading said beverage can;

(c) a shaft attaching said shader spaced from and above said cozy, said shaft comprised of:

(i) a lower shaft portion attached to said cozy, (ii) an upper shaft portion attached at a distal end to said shader, and (iii) a hinge connected to a distal end of said lower shaft portion and a proximal end of said upper shaft portion; and (d) means to remove said shader from a position above said cozy.

10. The apparatus of claim 9, wherein said cozy is comprised of a hollow, cylindrical piece of insulating material with at least one open end.

11. The apparatus of claim 9, wherein said cozy is further comprised of a structure with a closed base wherein said base is ballasted.

12. The apparatus of claim 11, wherein said base is penetrated by a hole.

13. The apparatus of claim 11, wherein said base is flared to a diameter greater than the diameter of the open end.

14. The apparatus of claim 9, wherein said shader is circular, having a concave and a convex surface.

15. The apparatus of claim 14, wherein said concave surface is adjacent to the cozy.

16. The apparatus of claim 14, wherein said convex surface is reflective.

17. The apparatus of claim 9, wherein said lower shaft portion is rigidly affixed to said cozy.

18. The apparatus of claim 9, wherein said upper shaft portion is rotatably attached to said lower shaft portion by said hinge.

19. The apparatus of claim 18, wherein the rotation of said upper shaft portion is limited by a stop notch on said hinge dimensioned to engage the upper surface of said lower shaft portion.

20. The apparatus of claim 9, wherein the proximal end of said upper shaft portion is pivotably attached to said hinge.

21. The apparatus of claim 18, wherein said shader is rotatably attached to the distal end of said upper shaft portion by a second hinge.

22. The apparatus of claim 21, wherein said upper shaft portion and said second hinge are sufficiently weighted so that the center of gravity for the system comprised of the shader, the upper shaft portion, and the second hinge is behind the plane including the lower shaft portion.

23. The apparatus of claim 9, wherein said means to remove said shader is comprised of:

(a) a lever rotatably attached to the proximal end of said lower shaft portion;

(b) a spring positioned between said lever and said lower shaft portion; and (c) a string attached at one end near the distal end of said lower shaft portion.

24. The apparatus of claim 23, wherein the lever's rotation toward the lower shaft portion is opposed by said spring.

25. The apparatus of claim 23, wherein the lever's rotation away from the lower shaft portion is limited by the string.

26. The apparatus of claim 23, wherein said string passes through a hole penetrating the distal end of said lower shaft portion.

27. The apparatus of claim 23, wherein said string is further attached to said hinge.

28. The apparatus of claim 23, wherein said string is further attached to said upper shaft portion.

29. The apparatus of claim 23, wherein the means to retract said shade is further comprised of a cover attached to said cozy and over said lever and said spring.

30. The apparatus of claim 29, wherein said cover is penetrated by at least one vent hole.

31. The apparatus of claim 9 wherein said shader is dome shaped.

* * * * *